US005285667A

United States Patent [19]

Fukasawa et al.

[11] Patent Number: 5,285,667

[45] Date of Patent: Feb. 15, 1994

[54] CYLINDER LOCK

[75] Inventors: Takeshi Fukasawa; Junji Ohkawara, both of Yokohama, Japan

[73] Assignee: Alpha Corporation, Kawasaki, Japan

[21] Appl. No.: 798,573

[22] Filed: Nov. 26, 1991

[30] Foreign Application Priority Data

Nov. 30, 1990 [JP] Japan ..... 2-330273
Nov. 30, 1990 [JP] Japan ..... 2-330274

[51] Int. Cl.[5] ..... E05B 9/10

[52] U.S. Cl. ..... 70/379 R; 70/360; 70/380

[58] Field of Search ..... 70/367, 369, 371, 379-380, 70/356, 360, 416, 422

[56] References Cited

U.S. PATENT DOCUMENTS

| | | | |
|---|---|---|---|
| 3,167,943 | 2/1965 | Schreiber et al. | 70/367 X |
| 3,659,444 | 5/1972 | Wellekens | 70/360 |
| 4,069,695 | 1/1978 | Frank | 70/422 X |
| 4,250,725 | 2/1981 | Prunbauer | 70/356 X |
| 4,841,758 | 6/1989 | Ramblier | 70/356 X |
| 4,903,512 | 2/1990 | Leroy et al. | 70/380 X |
| 4,936,895 | 6/1990 | Leclerc et al. | 70/422 X |
| 5,010,755 | 4/1991 | Best | 70/422 |
| 5,040,652 | 8/1991 | Fish et al. | 70/422 X |
| 5,044,183 | 9/1991 | Neyret | 70/329 R X |

FOREIGN PATENT DOCUMENTS

| | | | |
|---|---|---|---|
| 1157961 | 11/1963 | Fed. Rep. of Germany | 70/380 |
| 1808633 | 6/1970 | Fed. Rep. of Germany | 70/367 |
| 2528712 | 1/1977 | Fed. Rep. of Germany | 70/422 |
| 996052 | 6/1965 | United Kingdom | 70/380 |

*Primary Examiner*—Peter M. Cuomo
*Assistant Examiner*—Suzanne L. Dino
*Attorney, Agent, or Firm*—Bachman & LaPointe

[57] ABSTRACT

A cylinder lock is disclosed having significant resistance to damage or tampering. The cylinder lock comprises a cam provided on the key cylinder; and a pair of pins disposed radially slidably in openings provided in the sleeve rotatably disposed within a casing. The pins are moved within the openings of the sleeve by the cam on the key cylinder which is rotatably positioned within the sleeve when the key cylinder is turned by a proper key independently of the sleeve to a predetermined angle, as tumblers provided within the key cylinder are disengaged from the sleeve. Then, the pin comes into engagement with and is rotated with the connector together to unlock the lock device.

10 Claims, 8 Drawing Sheets

CYLINDER LOCK

FIELD OF THE INVENTION

The present invention relates, in general, to lock devices, and more particularly, to a cylinder lock that provides significant resistance to damage or tampering.

PRIOR ART

In a conventional cylinder lock, a key cylinder is rotatably mounted within a casing of the lock and a proper key may be inserted into and rotated with the key cylinder from locked to unlocked position. Tumblers are slidably disposed within slits formed in the key cylinder to engage with or disengage from a groove formed in a casing of the lock. In prior art cylinder locks, the tumblers engage with the groove in the casing to prevent unauthorized rotation of the key cylinder. Therefore, these locks might involve a risk of unallowed attempts to unlock or tamper by damaging the tumblers.

For example, as disclosed in U.S. Pat. No. 4,903,512, a free-turn type cylinder lock has been proposed wherein the key cylinder is designed to freely rotate against unallowed attempt to unlock when rotational force is applied to the key cylinder. Such a cylinder lock includes a sleeve rotatably arranged in the casing; and a key cylinder supported within the sleeve for rotation. When a correct key is inserted into the key cylinder, the tumblers within the key cylinder are moved for disengagement from the groove formed in the sleeve, and thereby the key cylinder may be rotated independently of the sleeve so that a sliding ring engages with a lock-piece operating member to actuate the lock. If an incorrect key is inserted into the key cylinder, the sleeve is kept in engaged condition by the tumblers with the key cylinder to rotate them together. This prevents rotation of the lock-piece operating member to inhibit unauthorized actuation of the lock.

If an incorrect key is inserted into the key cylinder of such free-turn type cylinder lock and then rotated, the key cylinder freely rotates with the incorrect key, and there will not be produced excessive force that might damage the tumblers and therefore significant resistance of the locks to damage is obtained. However, the lock disclosed in U.S. Pat. No. 4,903,512 has the disadvantage that the key cylinder cannot be turned smoothly once an unauthorized key is inserted and rotated. A torsion coil spring is provided between the front plate and the key cylinder within the lock in order to automatically return the rotated key cylinder to its initial position. If an incorrect key is inserted into the key cylinder and rotated, the sleeve and the key cylinder are freely turned together, then the torsion coil spring produces a resisting force. However, if they are rotated over a predetermined angle, the torsion coil spring restricts rotation of the key cylinder. This might pose a possibility that the torsion coil spring may be broken or damaged. However, without the torsion coil spring, the key cylinder will not be automatically returned to its initial position when the key cylinder is rotated with the correct key. Accordingly, the prior art lock has another disadvantage as it is difficult to utilize a lock of the structure of the '512 patent to actuate remote locking devices utilizing radio wave or infrared ray. Furthermore, due to axial movement of the sliding ring of the lock of the above U.S. Patent along the key cylinder, another shortcoming is that the lock is large in size and becomes complex in structure.

Accordingly, an object of the present invention is to provide a novel cylinder lock with a key cylinder capable of freely rotating against an unauthorized thorized attempt to unlock it.

It is another object of the present invention to provide a compact-sized free-turn type cylinder lock.

SUMMARY OF THE INVENTION

The cylinder lock according to the present invention includes a casing; a sleeve rotatably disposed in the casing; a key cylinder disposed rotatably within the sleeve; tumblers slidably disposed within each slit formed in the key cylinder for engagement with the sleeve; and a connector which is drivingly connected to a lock device. The cylinder lock also comprises a cam provided on the key cylinder; and at least a pin disposed radially slidably in an opening provided in the sleeve. The pin is moved within the opening of the sleeve by the cam on the key cylinder when the key cylinder is turned by a proper key relative to the sleeve to a predetermined angle so that the pin comes into engagement with the connector to rotate the connector together with the key cylinder and to unlock the lock device.

The cylinder lock may comprise a return spring disposed between the sleeve and the cylinder; a first return spring disposed between the sleeve and the cylinder; and a second return spring disposed between the casing and the connector.

The connector has a cylindrical portion extending outwardly of the sleeve and rotatable relative to and separately of the sleeve. The cylindrical portion has a resilient member provided thereon for resiliently urging the pin inwardly.

When a correct key is inserted into the key cylinder, the tumblers in the cylinder are moved away from the sleeve for disengagement to cause the key cylinder to turn independently of the sleeve. Then, when the key cylinder is manually rotated, the cam in the key cylinder is rotated. As the pin is in abutting engagement with the cam, the pin slides radially outwardly in the opening in the stationary sleeve and is brought into engagement with the connector. Thus, the key cylinder is rotated within an angular range for sliding of the pin against elastic force of the first return spring. Within the angular range for sliding of the pin, the pin radially slides with rotation of the key cylinder against elastic force of the resilient member attached to the connector, but neither the sleeve nor the connector will turn at this time. When the key cylinder is rotated further over the angular range for sliding of the pin, the connector is started to rotate during which the pin is rotated together with the key cylinder, sleeve and connector against elastic force of the second return spring, thereby rendering the connector to rotate into a locking or unlocking position. If manually rotational force is released from the correct key, the connector, sleeve and key cylinder are returned to their original position within the rotating range for the connector by resilient force of the second return spring between the casing and the connector. Subsequently, the key cylinder is returned to its original position within the angular range for sliding of the pin by elastic force of the first return spring, whereby the pin is moved radially inwardly to the original position by elastic force of the resilient member.

When the key cylinder is rotated with an incorrect key, the key cylinder is retained in the engaged condition with the sleeve by means of the tumblers so that it turns together with the sleeve. Thus, since the key cylinder will not rotate relative to the sleeve, the pin will not radially move within the opening in the sleeve. Therefore, the key cylinder will not be connected to the connector via the pin, thus preventing rotation of the connector.

The above-mentioned as well as other objects of the present invention will become apparent during the course of the following detailed description and appended claims.

DETAILED DESCRIPTION OF THE INVENTION

Referring to FIGS. 1 to 22, an embodiment of the present invention will be described.

Figure 1:
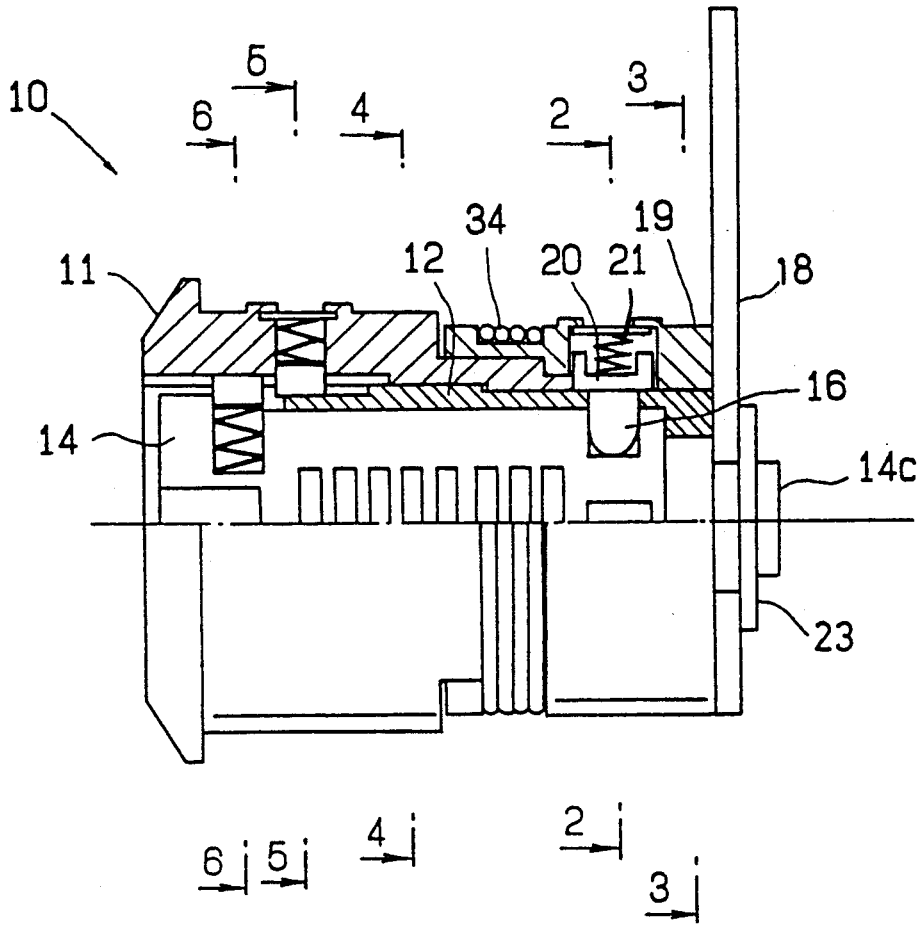
FIG. 1 is a cross-sectional view of a cylinder lock according to the present invention.
Figure 4:
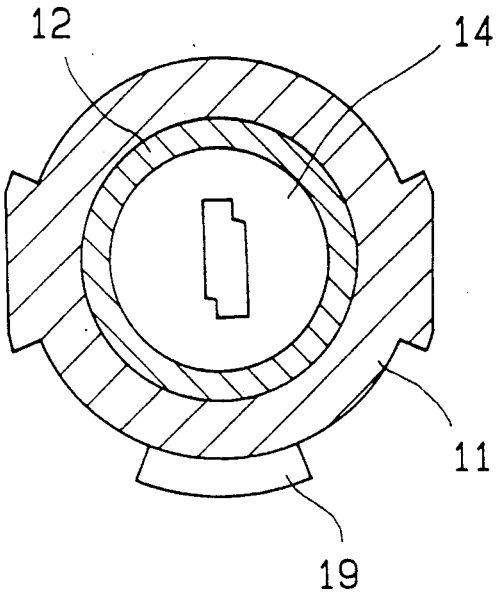
FIG. 4 is a cross-sectional view taken along line 4—4 of FIG. 1.
Figure 5:
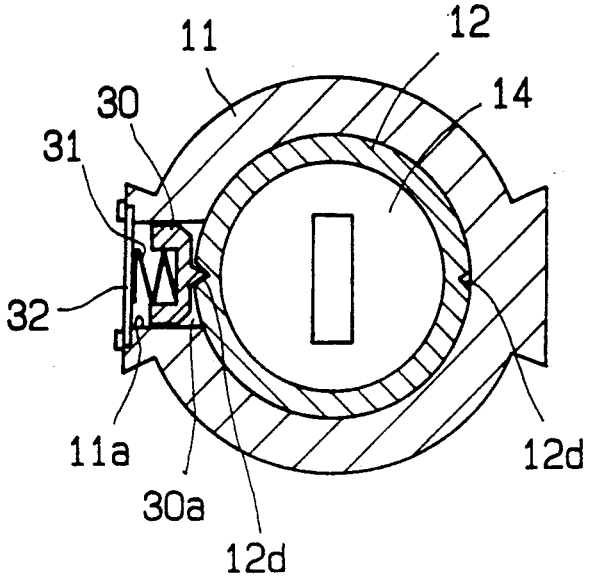
FIG. 5 is cross-sectional view taken along line 5—5 of FIG. 1.
Figure 6:
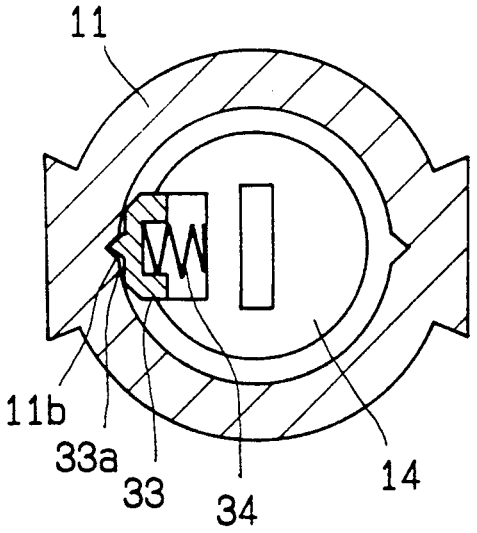
FIG. 6 is cross-sectional view taken along line 6—6 of FIG. 1.
Figure 7:
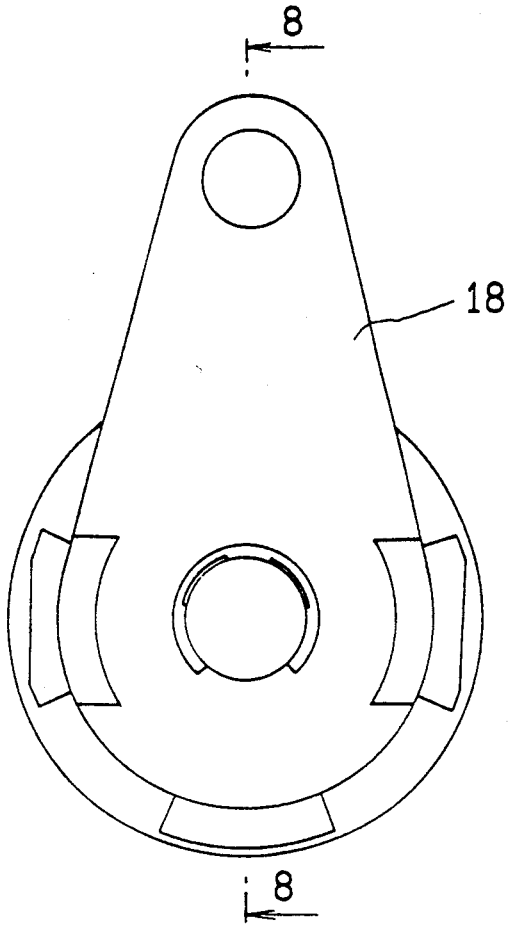
FIG. 7 is a rear view of the cylinder lock.
Figure 8:
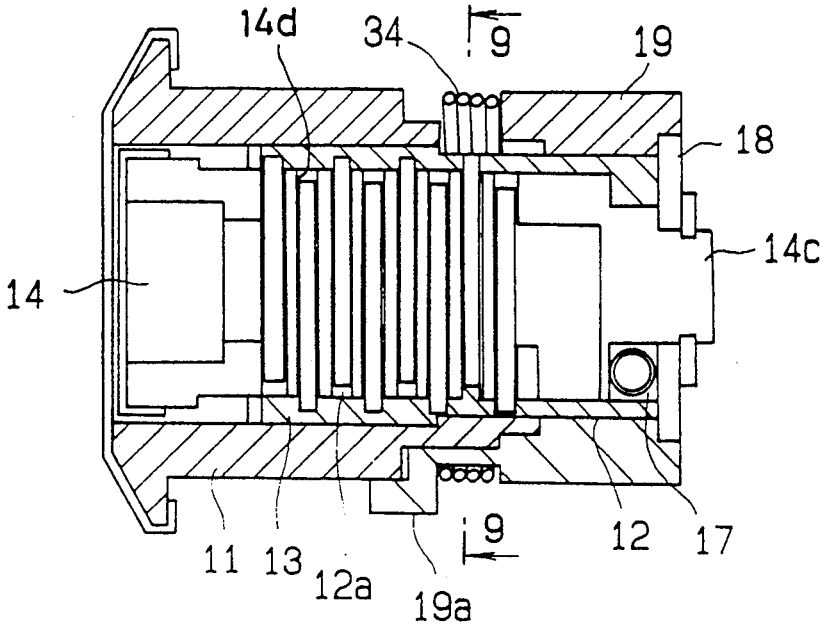
FIG. 8 is a cross-sectional view taken along line 8—8 of FIG. 7.
Figure 9:
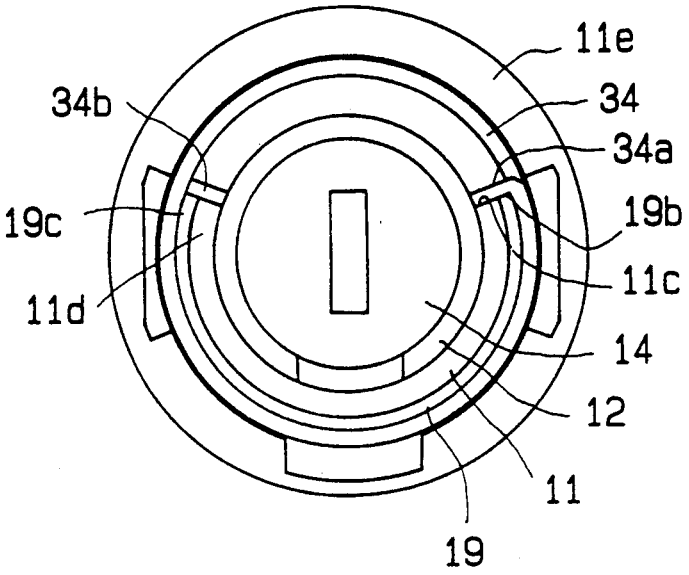
FIG. 9 is a cross-sectional view taken along line 9—9 of FIG. 7.
Figure 10:
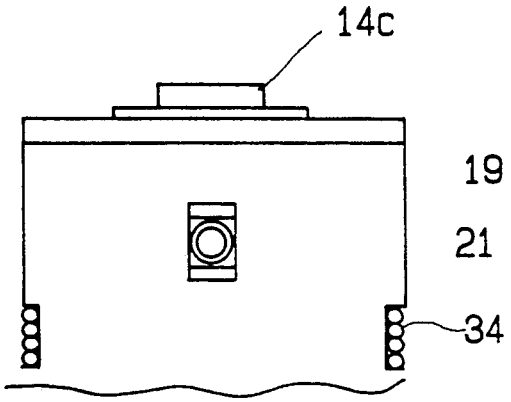
FIG. 10 is a plan view illustrating an end of the cylinder lock.
Figure 11:
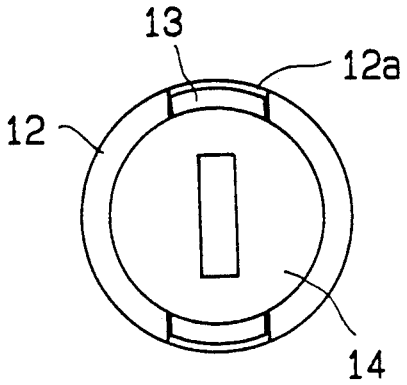
FIG. 11 is a partial cross-sectional view indicating the key cylinder and sleeve.

As illustrated in FIG. 1, the cylinder lock 10 according to the present invention comprises a casing 11, a sleeve 12 rotatably disposed within the casing 11, and a key cylinder 14 rotatably positioned in sleeve 12. As illustrated in FIG. 8 and FIG. 11, the key cylinder 14 has a plurality of tumblers 13 slidably disposed within slits 14*d* formed in the key cylinder 14 so that the tumblers 13 may protrude into and be engaged with groove 12*a* of sleeve 12, and the key cylinder 14 is retained in an engaged condition with sleeve 12 by means of tumblers 13 in a well known manner. As will be apparent from FIG. 2, which shows a cross-sectional view along line 2—2 of FIG. 1, formed on the key cylinder 14 is a cam 15 to which each inner end of a pair of pins (cam followers) 16 is abutted. The outer end of each pin 16 is radially slidably positioned in a corresponding opening 12*b* radially formed in the sleeve 12. As shown in FIGS. 1, 7 and 8, a connector 18 is rotatably attached to an inner end 14*c* of the key cylinder 14 for example by an E-ring 23. The connector 18 has a cylindrical portion 19 positioned outside the sleeve 12 and may rotate relative to and independently of sleeve 12. Formed in the cylindrical portion 19 is a radial hole 19*a* in which a pin (outer pin) 20 and a spring 21 are positioned to resiliently urge each pin 16 inwardly toward the cam 15. A plate 22 is fixed to the cylindrical portion 19 to prevent detachment of the spring 21. The pin 20 has its outer diameter approximately equal to that of pin 16. When a correct key is removed from key cylinder 14, the outer end of the pin 16 does not protrude outside the opening 12*b* of sleeve 12, but may be positioned at the boundary between sleeve 12 and cylindrical section 19. As illustrated in FIG. 3 showing a cross-sectional view taken along line 3—3 of FIG. 1, a first return spring 17 is disposed within a space defined by an arcuate groove 14*a* of key cylinder 14 and arcuate groove 12*c* of sleeve 12. FIG. 4 shows a cross-sectional view along line 4—4 of FIG. 1 in which the sleeve 12 is rotatably positioned inside the casing 11. FIG. 5 shows a cross-sectional view along line 5—5 of FIG. 1 in which a latch member 30 and a spring 31 are positioned in an opening 11*a* formed in casing 11. The latch member 30 has a claw 30*a* which is resiliently urged toward the outer surface of the sleeve by the spring 31. A plate 32 is fixed to the casing 11 to prevent detachment of the spring 31. The claw 30*a* of latch member 30 engages with a notch 12*d* formed in sleeve 12. FIG. 6 shows a cross-sectional view along line 6—6 in which a notch 14*b* is formed in key cylinder 14 to receive a latch member 33 and a spring 34 to elastically urge the latch member 33 outwardly. A claw 33*a* is formed with the latch member 33 to engage with a notch 11*b* formed in the casing 11. As shown in FIGS. 8 and 9, a second spring 34 is wound around the cylindrical portion 19 of the connector 18. The cylindrical portion 19 has a notch defined by edges 19*b* and 19*c*, and the casing 11 has a notch defined by edges 11*c* and 11*d*. Ends 34*a* and 34*b* of the second spring 34 are respectively engaged with edges 19*b* and 19*c* of the cylindrical portion 19, and edges 11*c* and 11*d* of the casing 11. The casing is formed with a flange 11*e*. Not shown, but the connector 18 is drivingly connected to a locking mechanism such as a door lock device by a rod in a known manner.

Before a key is inserted into the cylinder lock 10, the sleeve 12, key cylinder 14 and connector 18 are in the locked condition as shown in FIGS. 1 through 9. When a correct key is inserted into the key cylinder 14, the tumblers 13 are moved in the key cylinder 14 for disengagement from the sleeve 12, thus permitting key cylinder 14 to rotate independently of the sleeve 12. Then, when the key cylinder 14 is rotated, the sleeve 12 is held in a static condition due to its engagement with the latch member 30, while the pin 16 slides outwardly within the opening 12*b* of sleeve 12 from the inner position of FIG. 2 to the outer position of FIG. 12 by means of the rotating cam 15 of the key cylinder 14. Accordingly, the outer end of the pin 16 comes into engagement with the hole 19*a* formed in the cylindrical portion 19 of the connector 18.

Figure 2:
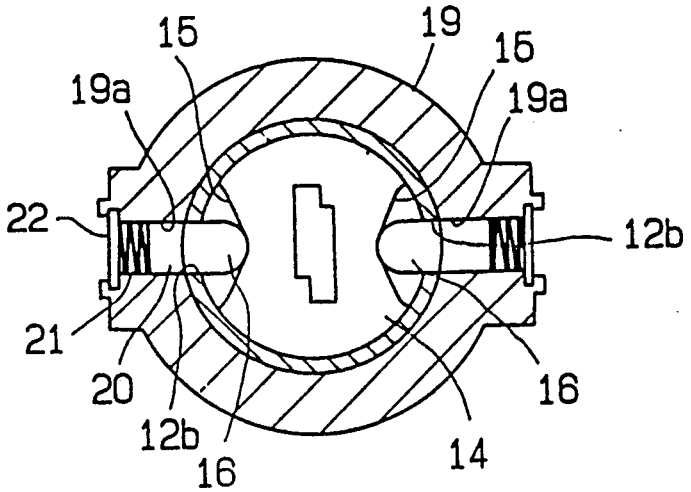
FIG. 2 is a cross-sectional view taken along line 2—2 of FIG. 1.
Figure 3:
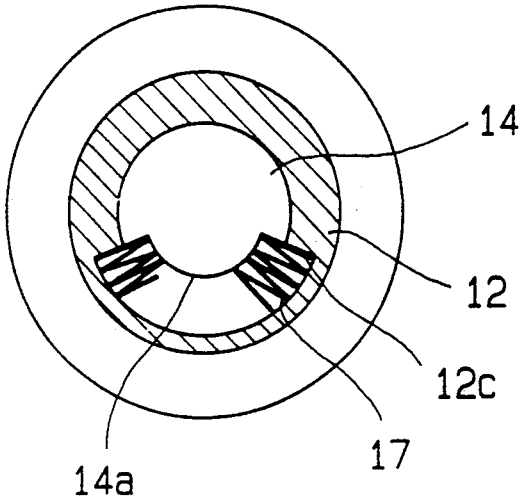
FIG. 3 is a cross-sectional view taken along line 3—3 of FIG. 1.
Figure 12:
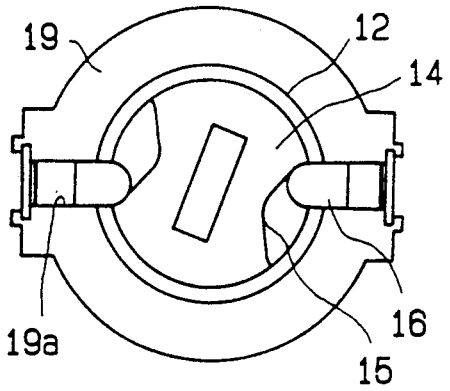
FIG. 12 is a cross-sectional view with the key cylinder turned with a proper key to the maximum angular position within the angular range for sliding of a pin.
Figure 20:
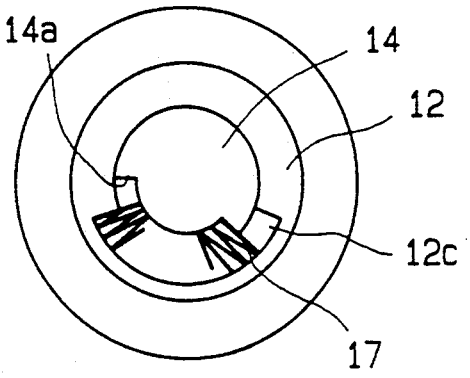
FIG. 20 is a cross-sectional view illustrating the relationship between the sleeve and key cylinder which has been turned by a proper key to an angle of about 20° from the position of FIG. 3.
Figure 21:
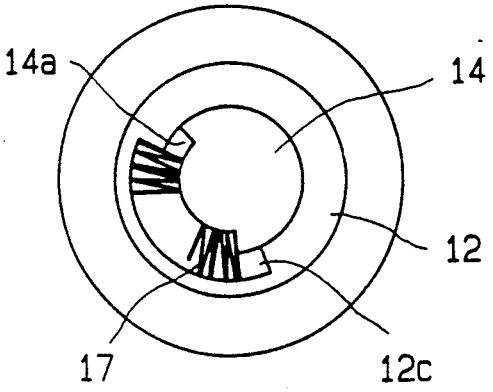
FIG. 21 is a cross-sectional view illustrating the relationship between the sleeve and key cylinder which has been turned by the proper key to an angle of about 65° from the position of FIG. 3.
Figure 22:
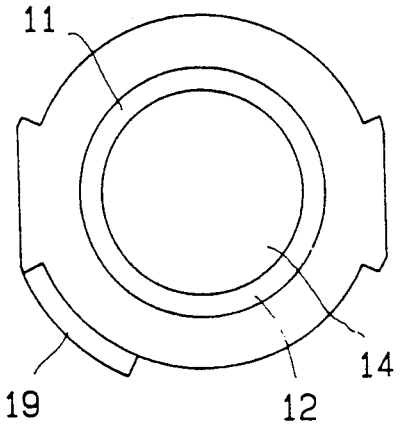
FIG. 22 is a cross-sectional view illustrating the relationship between the connector and the casing when the key cylinder has been turned by the proper key to an angle of about 65° from the position of FIG. 4.

Therefore, when the key cylinder 14 is turned within the angular range for sliding of the pin 16 against elastic force of the first return spring 17 from the initial position of FIG. 2 to the position shown in FIGS. 12, the first return spring 17 is compressed as shown in FIGS. 3 and 20. As the key cylinder 14 turns within the angular range for sliding of the pin 16, the pin 16 radially slides against elastic force of spring 21 within the cylindrical portion 19 without rotation of the sleeve 12 by the latch member 30 and connector 18 due to the only radial movement of the pin 16. When key cylinder 14 is further rotated beyond the angular range for sliding of the pin 16, the key cylinder 14, sleeve 12, pin 16 and connector 18 are together rotated from the position shown in FIG. 12 to that in FIG. 13 against elastic force of the second return spring 34 in the rotating range of the connector 18 which thus can be turned to a locked or unlocked position. The first return spring 17 is then forced from the condition of FIG. 20 to the state of FIG. 21 while the cylindrical portion 19 is moved from the locked position of FIG. 4 to the rotated condition of FIG. 22.

Figure 13:
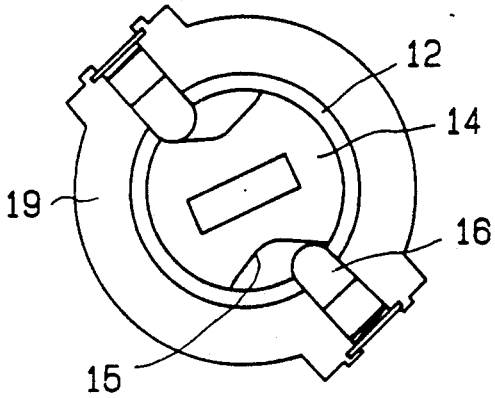
FIG. 13 is a cross-sectional view with the key cylinder turned within the angular range of rotation of the connector.
Figure 14:
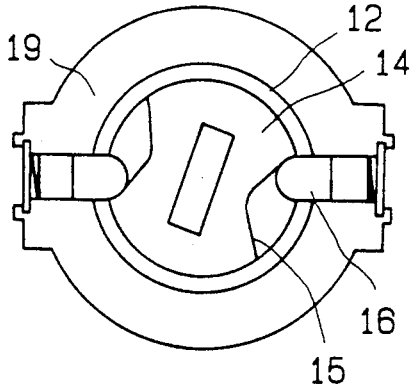
FIG. 14 is a cross-sectional view with the key cylinder returned within the angular range for sliding of the pin.
Figure 15:
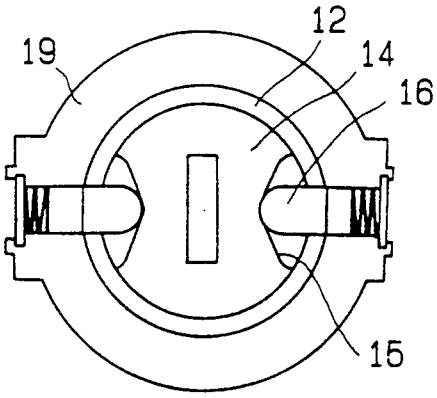
FIG. 15 is a cross-sectional view with the key cylinder returned to a position for removing the key.

When manual operation force is released from the rotated key, the second return spring 34 positioned between casing 11 and connector 18 forcibly and elastically pushes the connector 18, sleeve 12 and key cylinder 14 to return from the rotated position of FIG. 13 to the initial position of FIG. 14 in the angular range of rotation of connector 18. Subsequently, the key cylinder 14 is forced to return from the position of FIG. 14 to the initial position of FIG. 15 by virtue of elastic force of the first return spring 17 within the angular range for sliding of the pin 16 which is then radially and inwardly moved by elastic force of the spring 21 to the initial position.

Figure 16:
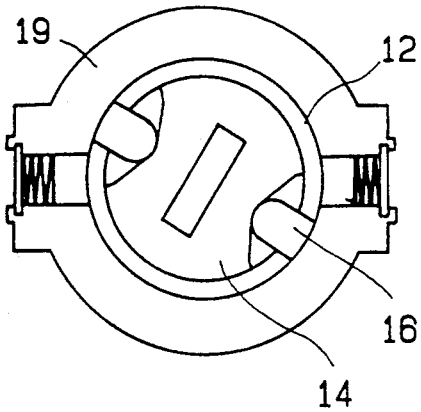
FIG. 16 is a cross-sectional view with the key cylinder turned to an angle of about 20° with an unacceptable key.
Figure 17:
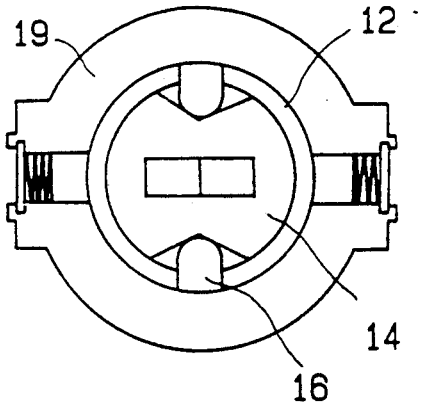
FIG. 17 is a cross-sectional view with the key cylinder turned to an angle of about 90°.
Figure 18:
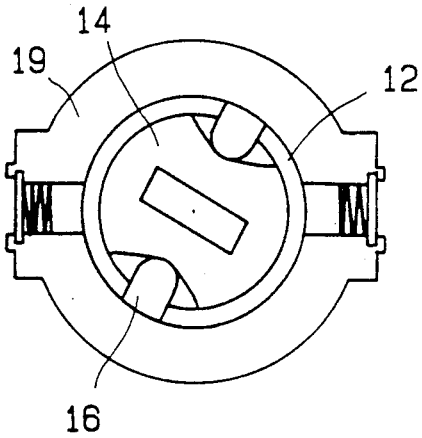
FIG. 18 is a cross-sectional view with the key cylinder turned to an angle of about 120°.
Figure 19:
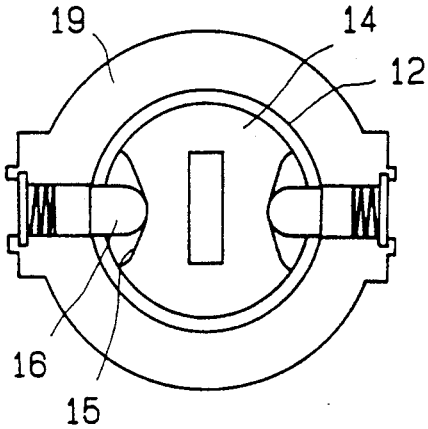
FIG. 19 is a cross-sectional view with the key cylinder turned to an angle of about 360°.

On the other hand, if the key cylinder 14 is rotated by an incorrect key, it is moved from the locked condition of FIG. 2 to the condition of FIG. 16, while the key cylinder 14 is retained in engaged condition with the sleeve 12 by tumblers 13 to rotate the key cylinder 14 and the sleeve 12 together. Thus, without production of relative rotation of the key cylinder 14 to the sleeve 12, the pin 16 will not radially move within opening 12*b* of sleeve 12. In other words, the key cylinder 14 will not engage with connector 18 via pin 16, thus preventing rotation of the connector 18. Therefore, the sleeve 12 and key cylinder 14 are freely rotated as FIGS. 17, 18 and 19 respectively indicate rotation thereof to about 90°, 120° and 360°.

As above-mentioned, the cylinder lock 10 according to the present invention allows the key cylinder 14 to turn together with sleeve 12 when an incorrect key is used to unlock, thus preventing rotation of connector 18. Therefore, no excessive external forces will be exerted on the tumblers 13, thus providing significant resistance to damage. Moreover, since the pin 16 may move radially, the key cylinder 14 may be made in reduced length for reduced size of the cylinder lock 10.

The present invention is not limited to the aforedescribed embodiment but may be modified in various ways. For example, a single pin 16 is utilized to connect the key cylinder 14 and the connector 18. In addition, pin tumblers may be used in lieu of tumblers 13 of disk type in the above embodiment. The cam 15 may be formed in an additional member which can rotate together with key cylinder 14.

As described above, the cylinder lock according to the present invention provides significant resistance to damage, thus effectively preventing unauthorized intrusion or theft.

What is claimed is:

1. A cylinder lock including a casing for receiving a key cylinder rotatably;

rotatable means disposed between said key cylinder and the casing;

releasable latch means in said casing for engaging and retaining said rotatable means static;

tumbler means disposed in the key cylinder operable to engage said rotatable means releasably;

said tumbler means normally making a first driving connection between the key cylinder and the rotatable means whereby the key cylinder and the rotatable means are operable to rotate in unison;

said tumbler means being responsive upon insertion of a proper key into said key cylinder to release the first driving connection whereby the key cylinder is operable to rotate independently of said rotatable means;

connector means carried by and movable rotatably relative to said rotatable means operable to actuate a lock device;

radial cam follower means received by said rotatable means operable to make a second driving connection between the key cylinder and the connector means;

cam means within said key cylinder operable upon rotation of said key cylinder in a first direction through a first angle while said rotatable means is static to drive said cam follower radially for effecting said second driving connection whereby further rotation of said key cylinder through a second angle is operable to release said latch means and to actuate said connector means in turn actuating said lock device.

2. The cylinder lock of claim 1 wherein the rotatable means is a sleeve formed with at least one radial opening providing access and guidance for the cam follower means operable to make the second driving connection.

3. The cylinder lock of claim 1 wherein the cam follower means operable to effect the second driving connection defines a spring pressed inner pin normally in contact with said cam means of said key cylinder.

4. The cylinder lock of claim 1 wherein the cam means operable upon rotation of the key cylinder through said first angle to effect said second driving connection is further operable to maintain said second driving connection between the key cylinder and rotatable means so that upon said further rotation of said key cylinder the latch means is released and, the key cylinder, the rotatable means and the connector means rotate in unison.

5. In a cylinder lock including a casing; a sleeve rotatably disposed in said casing; a key cylinder disposed rotatably within said sleeve; tumblers slidably disposed within said key cylinder for engagement with the sleeve; a connector drivingly connected to a lock device, a return spring disposed between the sleeve and the cylinder; a latch member provided in said casing for resiliently holding said sleeve in a static condition; the improvement comprising:

a cam provided on the key cylinder; and at least one inner pin disposed within an opening provided in the sleeve in contact with said cam and in a disengaged condition from said connector, said inner pin being slidably moved within said opening of the sleeve in a radial direction by rotation of the cam on the key cylinder relative to the sleeve to a predetermined angle when the key cylinder is turned by a proper key so that the inner pin comes into engagement with the connector which is rotated together with the key cylinder to unlock the lock device;

said inner pin being operable to move radially for engagement with said connector only upon relative rotation between said key cylinder and sleeve by the proper key;

an outer pin positioned within a radial hole; and a spring for resiliently urging said inner pin inwardly toward the cam by means of said outer pin.

6. The cylinder lock of claim 5 further comprising a pair of cams provided on the key cylinder; and a pair of pins disposed within each of the openings provided in the sleeve in contact with said cams and in a disengaged condition from said connector, each of said pins being slidably moved within said opening of the sleeve in a radial direction by rotation of the cams on the key cylinder relative to the sleeve to a predetermined angle when the key cylinder is turned by a proper key so that the pins come into engagement with the connector which is rotated together with the key cylinder to unlock the lock device.

7. The cylinder lock of claim 5 further comprising a first return spring disposed between the sleeve and the cylinder; and a second return spring disposed between the casing and the connector.

8. The cylinder lock of claim 5 wherein the connector has a cylindrical portion extending outwardly of the sleeve and rotatable relative to the sleeve.

9. The cylinder lock of claim 8 wherein the cylindrical portion has a resilient member provided thereon for resiliently urging the outer pin inwardly.

10. The cylinder lock of claim 5 wherein a pair of pins are disposed radially slidably in corresponding openings provided in the sleeve.

* * * * *